US009364705B2

(12) United States Patent
Thompson

(10) Patent No.: US 9,364,705 B2
(45) Date of Patent: Jun. 14, 2016

(54) ABDOMINAL EXERCISE APPARATUS

(71) Applicant: Robert Thompson, Homestead, FL (US)

(72) Inventor: Robert Thompson, Homestead, FL (US)

( * ) Notice: Subject to any disclaimer, the term of this patent is extended or adjusted under 35 U.S.C. 154(b) by 214 days.

(21) Appl. No.: 14/093,830

(22) Filed: Dec. 2, 2013

(65) Prior Publication Data

US 2014/0243173 A1 Aug. 28, 2014

Related U.S. Application Data

(60) Provisional application No. 61/768,081, filed on Feb. 22, 2013.

(51) Int. Cl.

| | |
|---|---|
| ***A63B 21/00*** | (2006.01) |
| ***A63B 21/16*** | (2006.01) |
| ***A63B 23/02*** | (2006.01) |

(52) U.S. Cl.

CPC ..... *A63B 21/143* (2013.01); *A63B 21/1654* (2013.01); *A63B 21/4015* (2015.10); *A63B 23/0211* (2013.01)

(58) Field of Classification Search

CPC ..... A63B 21/00

USPC ..... 482/904, 121, 126, 116

See application file for complete search history.

(56) References Cited

U.S. PATENT DOCUMENTS

| | | | | |
|---|---|---|---|---|
| 4,230,313 | A | 10/1980 | Chupp, Jr. | |
| 4,653,747 | A | 3/1987 | Newcomer | |
| 5,429,571 | A * | 7/1995 | Smith et al. | 482/115 |
| D369,841 | S | 5/1996 | Yang | |
| 7,670,271 | B2 | 3/2010 | Finch | |

* cited by examiner

*Primary Examiner* — Jerome W Donnelly

(74) *Attorney, Agent, or Firm* — The Gray Law Group, LTD; Robert Gray

(57) ABSTRACT

An abdominal workout assist device is disclosed. An elongated member and an attachment means are provided, and a support member is attached therebetween. The attachment means connects to the base of a door with the elongated member connected in parallel to the support member. In operation, the user inserts the device under a door and can perform standard abdominal exercises with the elongated member holding the user's feet on the ground. Additional exercises such as legs lifts can be done with the user holding the handles of the device while laying on their back and their arms extended back.

12 Claims, 3 Drawing Sheets

ABDOMINAL EXERCISE APPARATUS

CROSS-REFERENCE TO RELATED APPLICATIONS

This application claims priority to U.S. Provisional Application No. 61/768,081 filed Feb. 22, 2013, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to exercise devices and in particular to exercise device for the human abdominal and core regions. Abdominal exercises and similar focused movements are used to strengthen the core of a person. Many people however have difficulty with proper form whether it is an exercise or specific movement. Without the supervision of a trainer or use of machines that assist in movement, the individual cannot practice and learn proper form. Failure to use proper form may strain muscles and not help to develop proper muscle groups. An abdominal exercise assistance device directed to maintaining the proper form would help users improve the efficacy of their workout and avoid injury.

SUMMARY OF THE INVENTION

Accordingly, the invention is directed to an abdominal workout assist device. The device comprises an elongated member, an attachment means, and a support member attached therebetween. The attachment means connects to the base of a door with the elongated member connected in parallel to the support member. In operation, the user inserts the device under a door and can perform standard abdominal exercises with the elongated member holding the user's feet on the ground. Additional exercises such as legs lifts can be done with the user holding the handles of the device while laying on their back and their arms extended back. The device helps develop proper form without the assistance of a trainer or supervision.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWINGS

The accompanying drawings are included to provide a further understanding of the invention and are incorporated into and constitute a part of the specification. They illustrate two embodiments of the invention and, together with the description, serve to explain the principles of the invention.

DETAILED DESCRIPTION OF THE INVENTION

Referring now to the invention in more detail, the invention is directed to an abdominal workout assist device. The device comprises an elongated member 16, an attachment means 10, and a support member 14 attached therebetween.

Figure 1:
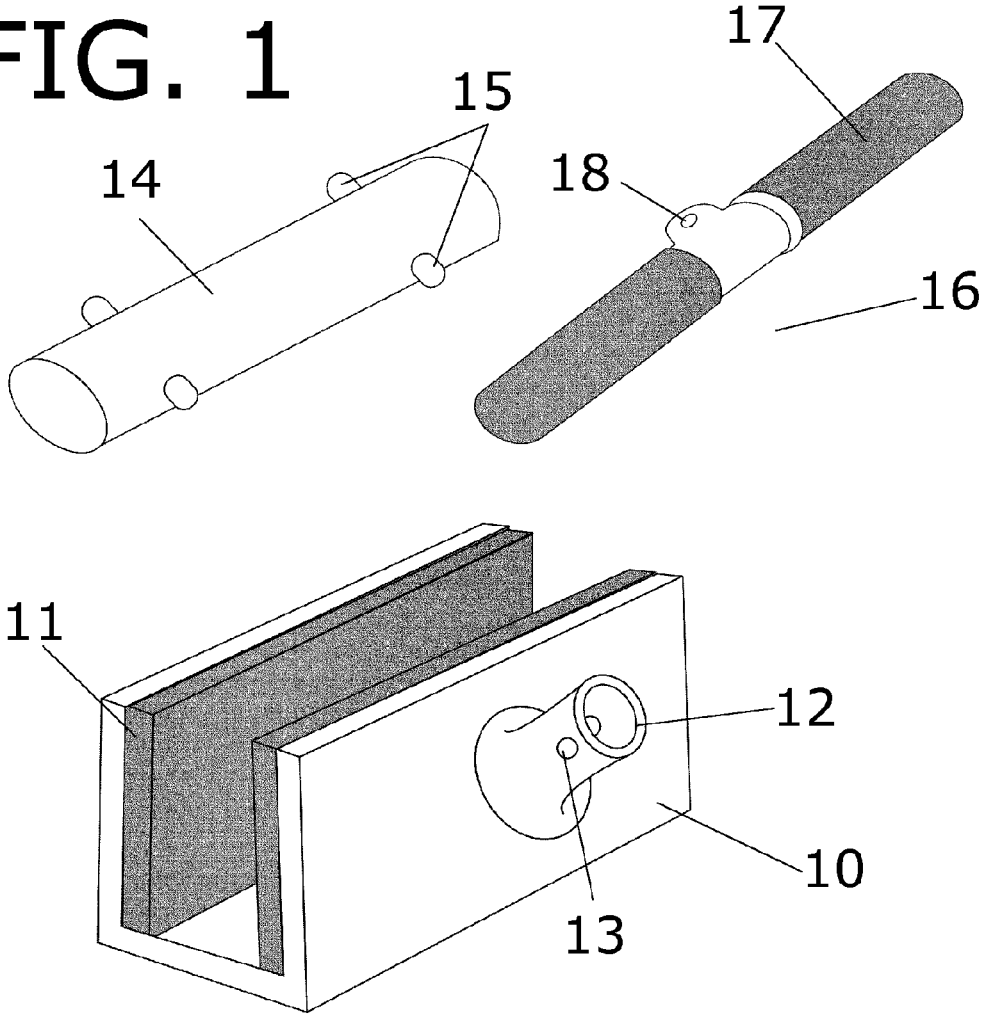
FIG. 1 shows a diagram of the present invention in a disassembled configuration, displaying the attachment means 10, padding layer 11, socket 12, pair of holes 13, support member 14, spring clips 15, elongated member 16, grips 17, and connector 18.

Referring now to FIG. 1, there is shown a diagram of the present invention unassembled, wherein the device comprises an elongated member 16, an attachment means 10, and a support member 14 that may connect therebetween. The device is compact and may be assembled whereby the support member 14 is accepted in a medial location of the attachment means 10.

Specifically, the attachment means 10 is affixed to or monolithically integrated with a socket 12 which engages with a one end of the support member 14. Spring clips 15 affixed to or embedded within each end of the support member 14 engage with a pair of holes 13 within the socket 12. The elongated member 16 also attaches medially to the support member 14 via a connector 18 comprising a pair of holes through which to accept the spring clips 15 of opposite end of the support member 14. The support member 14 is preferably constructed so that its ends are interchangeable and able to engage with wither the socket 12 or connector 18.

The support member 14 may be provided in a variety of lengths. For example, where the invention is provided commercially as a kit, several support members 14 of different lengths may be provided to accommodate user preference in the distance between the door and the handle.

Figure 1A:
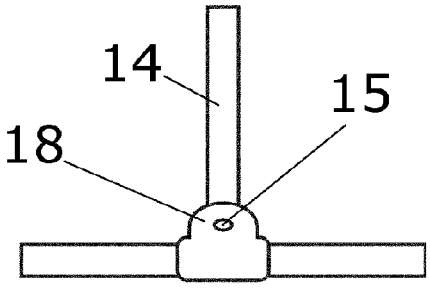
FIG. 1A shows a diagram of the present invention in a partially assembled configuration displaying the support member 14, spring clips 15, and connector 18.
Figure 2:
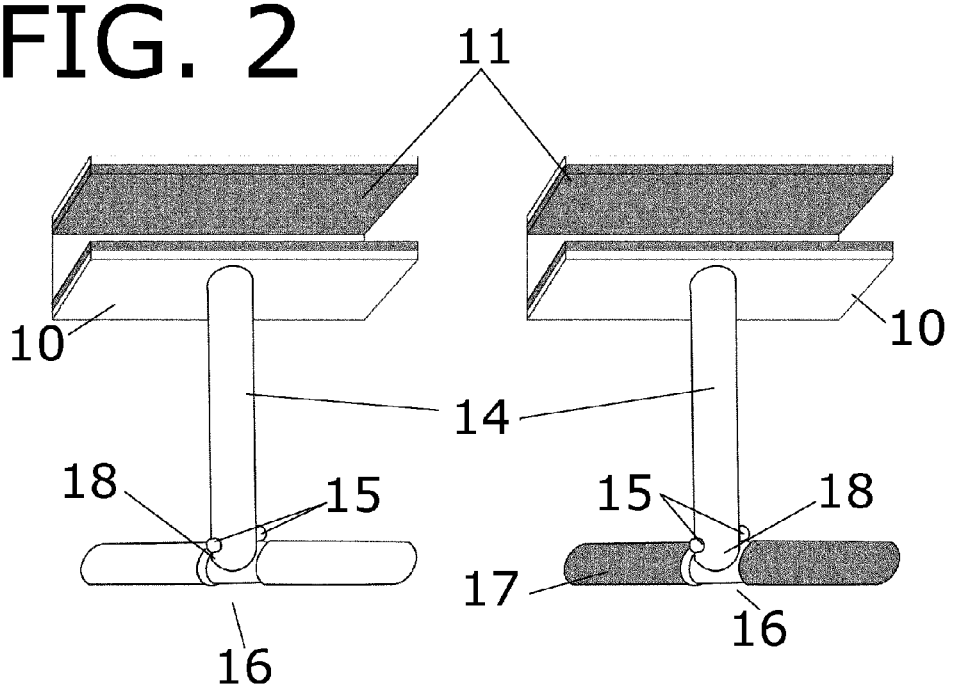
FIG. 2 shows a top perspective view of the first and second exemplary embodiments of the present invention, displaying the attachment means 10, padding layer 11, support member 14, spring clips 15, elongated member 16, grips 17, and connector 18.
Figure 3:
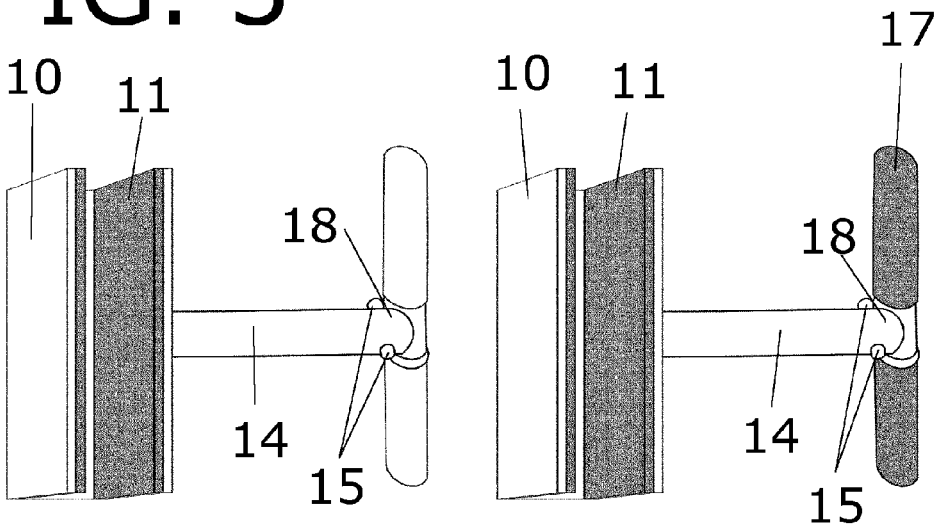
FIG. 3 shows a top rotated perspective view of the first and second exemplary embodiments of the present invention, displaying the attachment means 10, padding layer 11, support member 14, spring clips 15, elongated member 16, grips 17, and connector 18.

The attachment means 10 preferably comprises a U-shaped profile that surrounds the base of a closed door to hold the device in place. A padding layer 11, preferably made of a compressible and non-abrasive material may be affixed to the inner surface of the attachment means 10. The user may attach the elongated member 16 to the support member 14 before attaching the combined partial assembly of FIG. 1A to the attachment means located under the door. The partial assembly will form a T-section as shown.

Referring now to FIGS. 2-5, there are shown multiple perspective views of the present invention in two exemplary embodiments. In the first exemplary embodiment (shown at right in the figures), optional compressible grips 17 are provided surrounding the distal ends of the elongated member 16. In the second exemplary embodiment, the grips 17 are absent.

In operation, the device is assembled and placed by the device under a closed door. The user will lay on his or her back as if performing a standard push up. The user places his or her feet under the elongated member of the device for support. This simulates a similar technique wherein a person would hold the feet of a person performing a sit up. As the user begins to perform the exercise, the user will pull his body upwards and towards the door. Additional exercises such as leg lifts may be performed using the device. Depending on skill and focus of the exercise, the user may come completely or partially upward.

Figure 4:
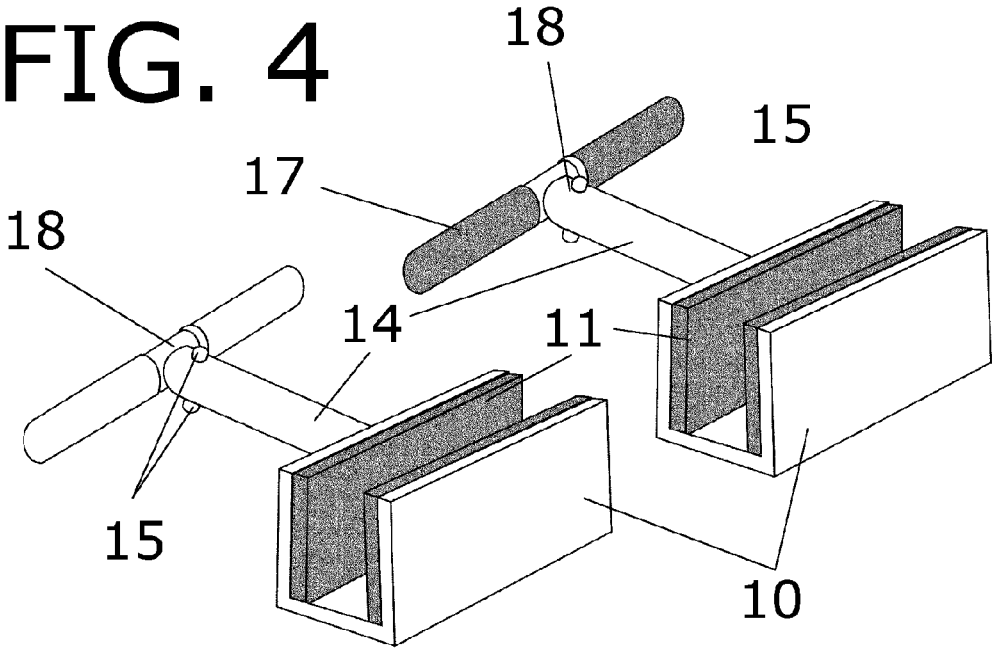
FIG. 4 shows a side-angle view of the first and second embodiments of the present invention, displaying the attachment means 10, padding layer 11, support member 14, spring clips 15, elongated member 16, grips 17, and connector 18.
Figure 5:
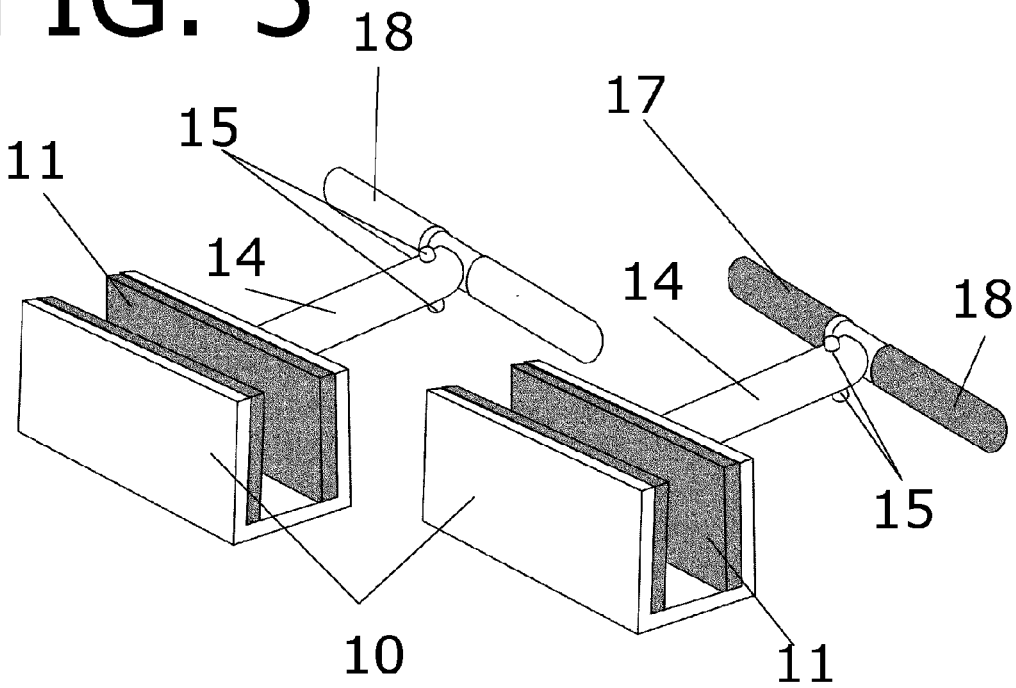
FIG. 5 shows a side-elevated view of the first and second exemplary embodiments of the present invention, displaying the attachment means 10, padding layer 11, support member 14, spring clips 15, elongated member 16, grips 17, and connector 18.

Referring now to FIGS. 4, and 5, there is shown a view of multiple embodiments of the present invention. With practice the user will become comfortable with abdominal workouts and also begin to strengthen his or her core. The user's core will become stronger and eventually perform variations of the basic sit up exercise with the device. For example, the user may choose to only use one foot to focus on a particular abdominal area. Throughout the entire use of the device the user can perform this alone and will not need assistance or supervision from another person. This can be helpful to people who do not work out often, may not go to the gym, or cannot afford the services of a personal trainer.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. An abdominal exercise apparatus comprising:

(a) an attachment means for attaching said apparatus to the underside of a door;

(b) an elongated member;

(c) a support member;

(d) said support member being releasably attachable to said attachment means for attaching said apparatus to the underside of a door;

(e) said support member being releasable attachable to said elongated member; and (f) such that said elongated member and said attachment means for attaching said apparatus to the underside of a door are about parallel when attached to said support member;

(g) wherein said apparatus is provided as a kit; and (h) wherein said elongated member comprises one of a plurality of provided members of varying length;

whereby a user may temporarily attach said apparatus to the underside of a door and use said elongated member as a brace for the performance of abdominal exercises.

2. An abdominal exercise apparatus comprising:

(a) an attachment means for attaching said apparatus to the underside of a door;

(b) an elongated member;

(c) a support member;

(d) said support member being releasably attachable to said attachment means for attaching said apparatus to the underside of a door;

(e) said support member being releasable attachable to said elongated member; and (f) such that said elongated member and said attachment means for attaching said apparatus to the underside of a door are about parallel when attached to said support member;

(g) wherein each end of said support member comprises a pair of spring clips;

(h) said pair of spring clips being configured to releasably engage with a pair compatible structures;

(i) the first of said pair of compatible structures being positioned medially on said elongated member and affixed thereto; and (j) the second of said pair of compatible structures being positioned medially on said attachment means for attaching said apparatus to the underside of a door and affixed thereto whereby a user may temporarily attach said apparatus to the underside of a door and use said elongated member as a brace for the performance of abdominal exercises.

3. The abdominal exercise apparatus of claim 1 wherein the distal ends of said elongated member are covered by a pair of grips.

4. The abdominal exercise apparatus of claim 1 wherein the inner surface of said attachment means for attaching said apparatus to the underside of a door is covered by a padding layer.

5. The abdominal exercise apparatus of claim 3 wherein the inner surface of said attachment means for attaching said apparatus to the underside of a door is covered by a padding layer.

6. The abdominal exercise apparatus of claim 1 wherein each end of said support member comprises a pair of spring clips, said pair of spring clips being configured to releasably engage with a pair compatible structures, the first of said pair of compatible structures being positioned medially on said elongated member and affixed thereto, and the second of said pair of compatible structures being positioned medially on said attachment means for attaching said apparatus to the underside of a door and affixed thereto.

7. The abdominal exercise apparatus of claim 3 wherein each end of said support member comprises a pair of spring clips, said pair of spring clips being configured to releasably engage with a pair compatible structures, the first of said pair of compatible structures being positioned medially on said elongated member and affixed thereto, and the second of said pair of compatible structures being positioned medially on said attachment means for attaching said apparatus to the underside of a door and affixed thereto.

8. The abdominal exercise apparatus of claim 4 wherein each end of said support member comprises a pair of spring clips, said pair of spring clips being configured to releasably engage with a pair compatible structures, the first of said pair of compatible structures being positioned medially on said elongated member and affixed thereto, and the second of said pair of compatible structures being positioned medially on said attachment means for attaching said apparatus to the underside of a door and affixed thereto.

9. The abdominal exercise apparatus of claim 5 wherein each end of said support member comprises a pair of spring clips, said pair of spring clips being configured to releasably engage with a pair compatible structures, the first of said pair of compatible structures being positioned medially on said elongated member and affixed thereto, and the second of said pair of compatible structures being positioned medially on said attachment means for attaching said apparatus to the underside of a door and affixed thereto.

10. The abdominal exercise apparatus of claim 2 wherein the distal ends of said elongated member are covered by a pair of grips.

11. The abdominal exercise apparatus of claim 2 wherein the inner surface of said attachment means for attaching said apparatus to the underside of a door is covered by a padding layer.

12. The abdominal exercise apparatus of claim 10 wherein the inner surface of said attachment means for attaching said apparatus to the underside of a door is covered by a padding layer.

* * * * *